United States Patent [19]

Hühne

[11] Patent Number: 4,574,677

[45] Date of Patent: Mar. 11, 1986

[54] CUTTING APPARATUS FOR PLASTIC FOAM SOLIDS

[75] Inventor: Siegmar Hühne, Wesel, Fed. Rep. of Germany

[73] Assignee: Münchow und Hühne Maschinenbaugesellschaft mbH, Duirburg, Fed. Rep. of Germany

[21] Appl. No.: 692,642

[22] Filed: Jan. 17, 1985

[30] Foreign Application Priority Data

Jan. 20, 1984 [DE] Fed. Rep. of Germany ..... 3401869

[51] Int. Cl.[4] ..... B26F 3/12; B26D 1/553

[52] U.S. Cl. ..... 83/870; 83/171; 83/651.1; 83/697; 83/698; 83/751

[58] Field of Search ..... 83/171, 651.1, 751, 83/563, 698, 697, 662, 870, 871

[56] References Cited

U.S. PATENT DOCUMENTS

| | | | |
|---|---|---|---|
| 2,430,160 | 11/1947 | Criner | 83/751 |
| 2,479,908 | 8/1949 | Criner | 83/751 |
| 4,018,116 | 4/1977 | Treffner et al. | 83/171 |
| 4,222,299 | 9/1980 | Treffner et al. | 83/870 |

*Primary Examiner*—Donald R. Schran

*Attorney, Agent, or Firm*—Karl F. Ross; Herbert Dubno

[57] ABSTRACT

A cutting apparatus for plastic foam solids or the like comprises a cutting wire system having a plurality of substantially parallel cutting wires attached eccentrically to at least two parallel supporting rods, the supporting rods being substantially perpendicular to the cutting wires and spaced from each other with clearance so that the plastic foam solid can be passed therebetween, the ends of the supporting rods being held rotatably pivotable in a rod frame, and also comprises an oscillating drive associated with and engaged to the supporting rods so as to rotatably oscillate the supporting rods about their longitudinal axes wherein the rod frame with the upper end of the frame pivotable around an axis parallel to the cutting wires is supported in a suspension recess of a frame support and is held with the aid of an adjustable strut adjacent the lower end of the rod frame against a supporting abutment projecting from the frame support, and that the rotatable lower end of at least one supporting rod is connected by way of a radial socket coupling with the oscillating drive. The rod frame is advantageously removed from the frame support with the aid of a raising apparatus which is preferably a pneumatic piston cylinder apparatus.

11 Claims, 6 Drawing Figures

CUTTING APPARATUS FOR PLASTIC FOAM SOLIDS

CROSS REFERENCE TO RELATED APPLICATION

This application is related to my commonly assigned concurrently filed copending application Ser. No. 692,038 based upon German applications Nos. P 34 01 910.3 of Jan. 20, 1984 and P 34 05 252.6 of Feb. 15, 1984.

FIELD OF THE INVENTION

My present invention relates to an apparatus for cutting articles and, more particularly, to a heated wire slicer for synthetic resin foam materials.

BACKGROUND OF THE INVENTION

Plastic foam bodies or the like can be sliced into slabs by an apparatus comprising a cutting wire system having a plurality of substantially parallel cutting wires attached eccentrically to at least two parallel supporting rods, the rods being substantially perpendicular to the cutting wires and being spaced from each other with clearance so that the plastic foam solid can be passed therebetween. The ends of the supporting rods are rotatably pivotable in a rod frame, and an oscillating drive is associated with the supporting rods about their longitudinal axes.

In the apparatus of this type described in the U.S. Pat. No. 4,222,299 (see also U.S. Pat. No. 4,018,116), such wire arrays can be heated to rapidly slice up a foam body fed therepast by suitable conveying means.

In operation the cutting wires can be torn or broken by tension produced by coil springs resiliently mounting the ends of the cutting wires to the bars. Basically the possibility exists, of course, to change or remove the broken wires or the springs. However that requires significant time during which the apparatus cannot work. For shortening this down-time the known apparatus is designed to enable changing all of the cutting wires at once.

For this purpose the cutting wires are attached to the supporting rods by a detachable support strip.

For changing the totality of the cutting wires therefore the support strips together with the cutting wires are removed from the supporting rods, and another pair of support strips with unbroken cutting wires attached is mounted upon the support bars. These actions require persons working high speed, because the cutting wires have a comparatively large clearance from one another and the support strip is constructed without a rigid structural member.

OBJECTS OF THE INVENTION

The principal object of this invention is to provide an apparatus for wire slicing in which changing the cutting wires all at once can be accomplished by one person in a comparatively shorter time than with the prior art apparatus.

It is an object of my invention to provide an improved cutting apparatus for plastic foam solids or the like in which replacement of the cutting wires is simplified, made more rapid, and can be effected with fewer personnel than heretofore required.

SUMMARY OF THE INVENTION

These objects and others which will become apparent hereinafter are attained in accordance with the invention in a cutting apparatus for plastic foam solids or the like comprising a cutting wire system having a plurality of substantially parallel cutting wires attached eccentrically to at least two parallel supporting rods, the rods being substantially perpendicular to the cutting wires and spaced from each other with clearance so that the plastic foam solid can be passed therebetween, the ends of the supporting rods being held rotatably pivotable in a rod frame, and also comprising an oscillating drive associated with and engaged to the supporting rods so as to rotatably oscillate the supporting rods about the longitudinal axes of the supporting rods.

According to my invention, in particular, the rod frame has an upper end pivotable about an axis parallel to the cutting wires and swingably received in a suspension recess of a frame support, and is held with the aid of an adjustable (and releasable and detachable) strut with its lower end against a supporting abutment projecting from the frame support, and that the rotatable lower end of at least one supporting rod is connected by way of a radial plug-and-socket coupling with the oscillating drive.

The invention is based upon the discovery that the aforedescribed objects are achieved if the rod frame is a more or less rigid structural member which as a whole is removable together with the supporting rods and, of course, the cutting wires spanning same. For removal of this rod frame I need only detach the adjustable retaining or bracing strut, to thus enable the rod frame to be lifted out of the notches or cradles swingably supporting its upper end.

According to a feature of the invention, the supporting abutments of the support are protruding portions of the frame support with spherical recesses conforming to and receiving a corresponding but opposite spherical projection formed on the rod frame.

The rod frame can be supported with at least two lateral pins attached to this frame on opposite sides thereof and engaged in the suspension recesses, notches or cradles in the frame support.

The rod frame is removable from the frame support by a lifting device engaging the top of the rod frame.

The adjustable strut must be detached however before the frame support can be removed.

The rod frame is guided during its removal and reinsertion by lowering by at least one guide pin attached laterally adjacent the lower end of its frame, the guide pin riding upon slanted bar-like guides attached to the frame support. Both the adjustable strut and the lifting device can advantageously be pneumatic piston-and-cylinder units in the preferred embodiment.

The current source for the electrically heated cutting wires comprises at least two spring-loaded carbon brushes for the supporting rods which bear upon these rods in the direction opposite the direction in which the adjustable support urges the rod frame into cutting position.

The radial socket coupling comprises two substantially trapezoidally shaped coupler-halves narrowed in the lengthwise direction of the supporting rods toward the adjustable strut, these coupler-halves being attached to the lower tapered end of one of the supporting rods.

BRIEF DESCRIPTION OF THE DRAWING

The above and other objects, features and advantages of my invention will become more readily apparent from the following detailed description, reference being made to the accompanying drawing in which.

SPECIFIC DESCRIPTION

Figure 1:
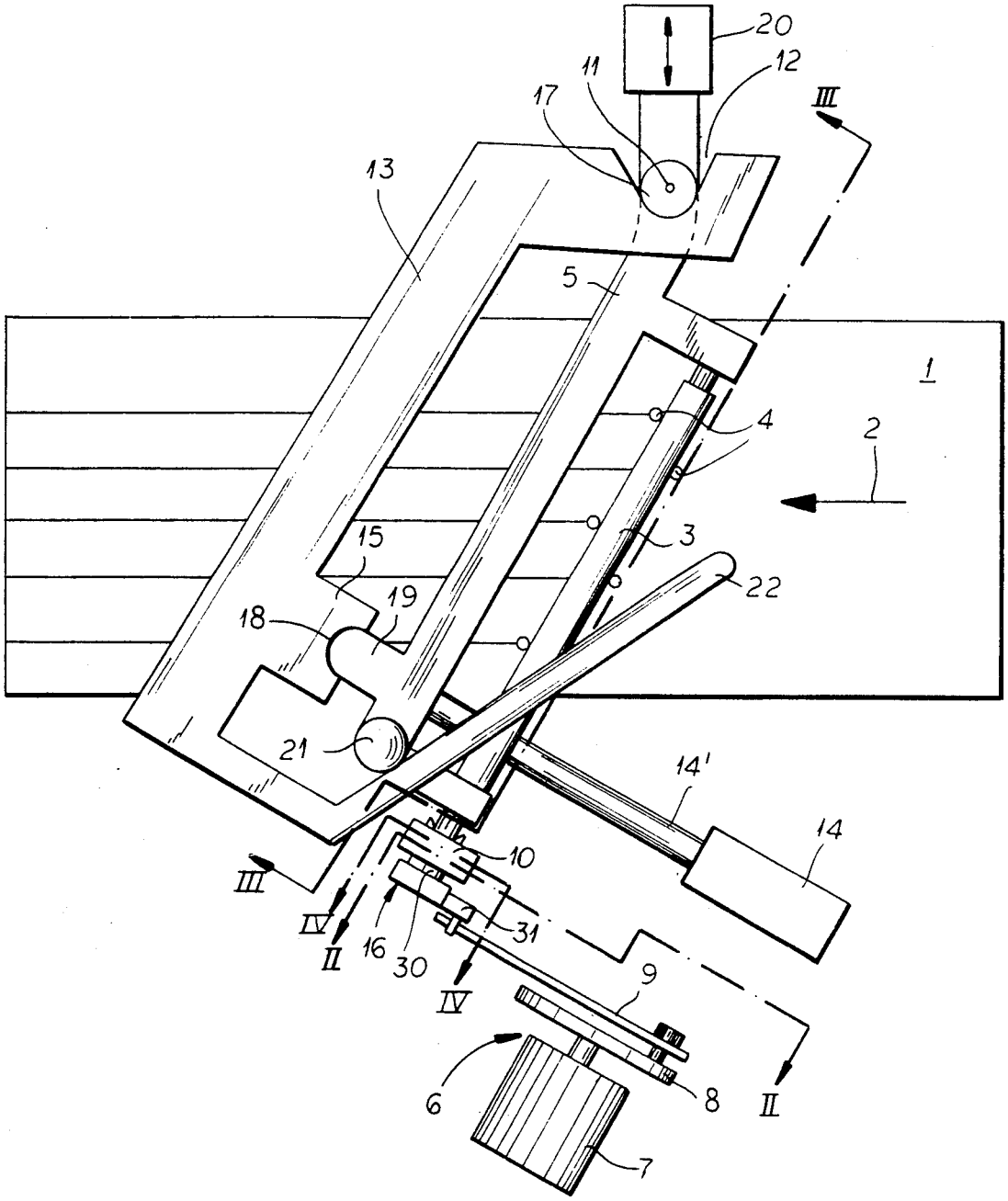
FIG. 1 is a side view of an apparatus for slicing plastic foam solids and the like according to the invention.

The apparatus shown in the drawing is used for hot-wire cutting plastic foam solids 1, for example, parallelepiped-shaped polystyrene foam solids into plates and, of course, with a cutting wire system. This cutting wire system can, as is shown in FIG. 1, be stationary, so that the plastic foam solid 1 can be moved in the direction of the arrow 2. Additionally there is the possibility that the cutting wire system be mounted on a movable carriage in an apparatus support and transported lengthwise to a stationary plastic foam solid 1.

The cutting wire configuration not shown here in its individual detail can be constructed in different ways, so, for example, with only two oscillating supporting rods 3 running opposite to each other, as is described in U.S. Pat. No. 4,222,299, or with only two rotatably oscillating supporting rods 3 each rotating in directions opposite the other, as in the U.S. patent application, or also with four supporting rods, which rotatably oscillate opposite to each other or with each other, when taken together pairwise, as is described in U.S. Pat. No. 4,018,116.

In any event, in all the aforementioned cases, the cutting wire system has a plurality of cutting wires essentially parallel to each other, which are attached eccentrically, usually at their ends, via springs 4' to at least two parallel supporting rods 3 perpendicular to the cutting wires 4 and the cutting wires can be in one of two cutting planes, each of the cutting wires in different cutting wire planes moving opposite to each other.

The supporting rods 3 are held pivotally rotatable at their downwardly open U-shaped rod frame 5 through which the plastic foam solid 1 can be passed and with the aid of an oscillating drive 6 associated with the lower ends of supporting rods 3 are rotatably oscillated around their long axes.

The oscillating drive 6 as shown in FIG. 1 comprises an eccentric drive with its motor 7, drive plate 8, and connecting rod 9. In the preferred embodiment the connecting rod 9 is attached eccentrically and pivotally to a circular drive plate 8 and eccentrically and pivotally to a socket coupling 16 engaged to the lower end of one of the supporting rods 3. According to FIG. 2 a second supporting rod 3 not shown in FIG. 1 is coupled by a synchronous coupling generally shown at 10 with the first supporting rod 3. This coupling may use the principles of my above-mentioned copending application.

Rod frame 5 has a traverse member **5*a* and a pair of downwardly extending legs 5*b*, 5*c*** straddling the body.

The rod frame 5 is suspended swingably by its upper end in a suspension recess 12 of a frame support 13, the rotation axis 11 of its upper end being parallel with the cutting wires 4. The rod frame 5 is supported at its lower end with the aid of detachable adjustable strut 14 against support abutment 15 on the frame support 13.

The strut 14 can have a piston rod 14' nested in a seat **5*d* of each leg 5*b*, 5*c*** and from which it can be withdrawn.

The rod frame 5 is suspended in the suspension recesses, notches or cradles 12 with lateral pins 17 and like the frame support 13 is constructed as a U-shaped structure with a transverse upper bar **13*a* and downwardly extending legs 13*b*, 13*c*. The support frame 13 is swingable about a horizontal axis (not shown), to adjust slab cut thickness, upon the usual machine body or frame. The lower bar is, however, missing or at least substantially shortened, while in its corresponding place one finds another apparatus member, a transport belt 40 for the plastic foam solid 1**.

In this case the frame support 13 is shown as part of the stationary apparatus; it can, however, also as has already been mentioned above, be arranged on a movable carriage with respect to which the body 1 remains stationary.

The supporting abutment 15 of each leg **13*b*, 13*c* engageable by the rod frame 5 has a spherical recess 18 in which by operating the adjustable strut 14 the corresponding spherical projection 19 on rod frame 5** is engaged.

The current source C for the heatable cutting wires 4 is connected to respective spring-loaded carbon brushes 33, which contact the supporting rods 3 in a direction opposite the force application direction of and at the level of the adjustable strut 14.

The current flow in the wires 4, commences when the adjustable strut 14 is engaged in position and resistively heats the wires to enable them to melt through the body 1.

From FIG. 1 one can deduce that the rod frame 5, after detachment of the adjustable strut 14 with the aid of lifting device 20, can be removed from the frame support 13. To facilitate the swinging of the rod frame 5 into and out of position on the support 13, it is provided with at least one lower guide pin 21 laterally attached to the lower ends of rod frame 5 and guided on the slanted guides 22 of the frame support 13.

The lifting apparatus 20 comprises at least one pneumatic piston cylinder apparatus attached to the upper ends of the rod frame 5. Also the adjustable strut 14 can comprise at least one such pneumatic piston cylinder apparatus.

Figure 2:
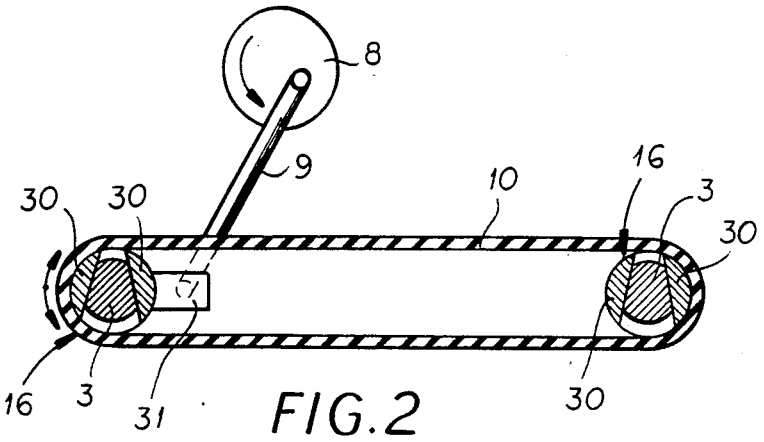
FIG. 2 is a diagrammatic cross sectional view of a portion of the cutting apparatus taken along the line II—II of FIG. 1.
Figure 4:
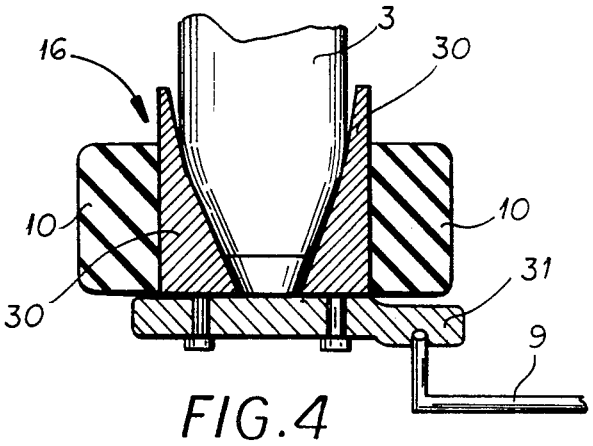
FIG. 4 is a cross-sectional view of the coupler.
Figure 5:
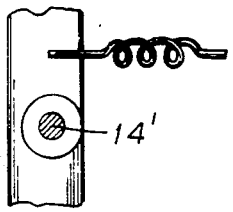
FIG. 5 is a detail section showing engagement of the detachable strut.
Figure 6:
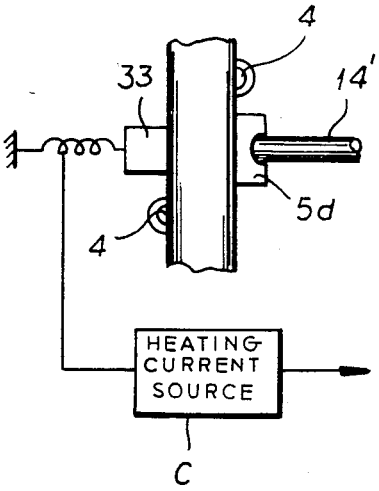
FIG. 6 is a detail elevation of this latter portion.
Figure 3:
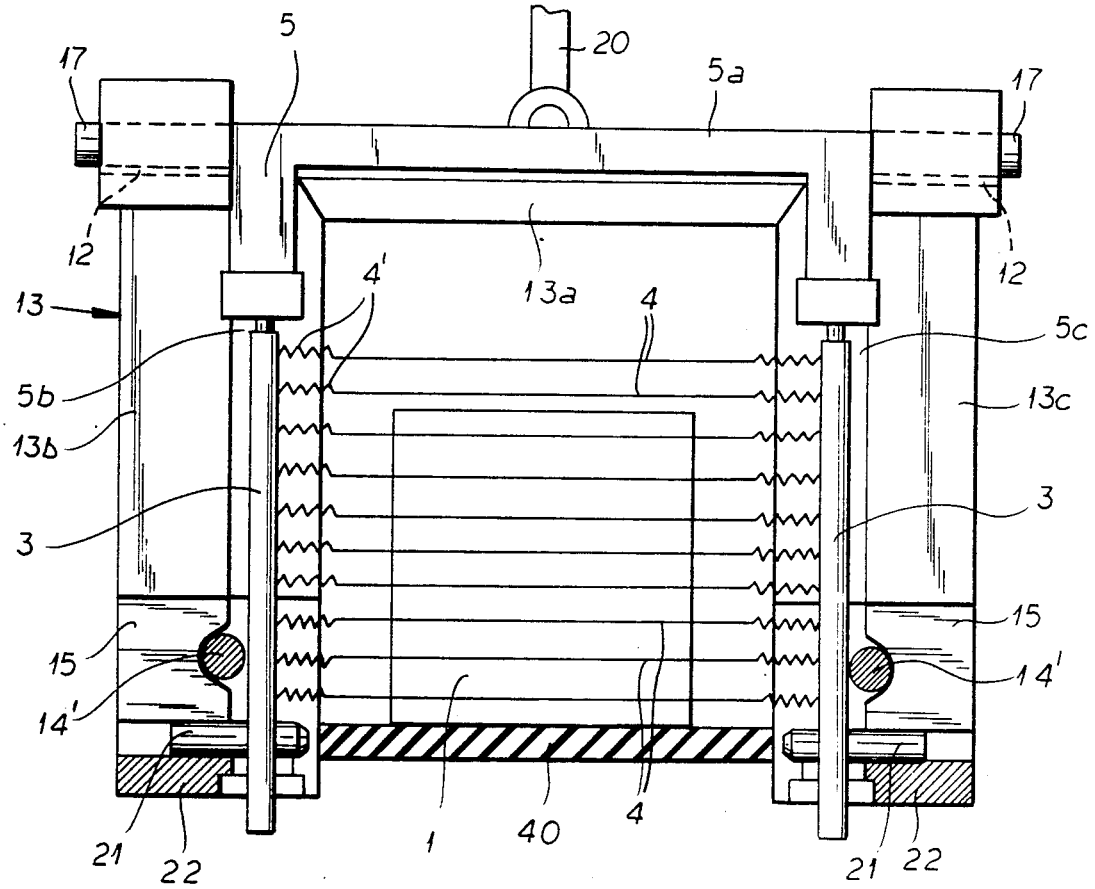
FIG. 3 is a schematic front view of the apparatus of FIG. 1.

FIGS. 2 and 4 show how the radial socket couplings 16 are constructed, they each comprise two substantially trapezoidally shaped coupler-halves 30 narrowed in the lengthwise direction toward the adjustable strut 14. Each of the couplings 16 is attached to the lower narrowed, tapered end of the supporting rods 3. One coupler-half 30 has a protrusion 31 to which drive connecting rod 9 is pivotally attached. Synchronous coupling 10 couples the motion of the supporting rods 3 by way of the socket coupling 16 in the preferred embodiment. Synchronous coupling 10 may advantageously be a continuous belt coupling simply looped about the socket couplings 16 of the two supporting rods 3 or looped in the shape of a figure-8 so that the supporting rods 3 can be rotationally oscillated with directions of rotation opposite each other.

I claim:

1. In a cutting apparatus for a body in which a cutting wire system has a plurality of substantially parallel cutting wires attached eccentrically to at least two parallel supporting rods, said rods being substantially perpendicular to said cutting wires and spaced from each other with clearance so that said body can be passed therebetween, the ends of said supporting rods being rotatably pivotable in a rod frame, and an oscillating drive connectable with said supporting rods so as to rotatably oscillate said supporting rods about their longitudinal axes, the improvement wherein:

said rod frame has an upper end swingable about an axis parallel to said cutting wires and removably supported in an upwardly open suspension recess provided in a frame support;

said rod frame is braced by a detachable strut with its lower end against at least one supporting abutment projecting from said frame support; and a lower end of at least one of said supporting rods is connected by a radial plug-and-socket coupling with said oscillating drive.

2. The improvement defined in claim 1 wherein said rod frame is supported by at least two lateral pins attached to said rod frame on opposite sides thereof and received in respective cradles of said frame support.

3. The improvement defined in claim 2 wherein that said red frame and said frame support are constructed as substantially U-shaped structures with respective upper bars and downwardly extending legs stadddling said body.

4. The improvement defined in claim 1 wherein that said frame support is mounted at a fixed location and means is provided to move said body past said frame support.

5. The improvement defined in claim 3 wherein said supporting abutment comprises a spherical recess formed in a protruding portion of said frame support and complementary to a spherical projection formed on said rod frame.

6. The improvement defined in claim 5, further comprising a current source for electrically heating said cutting wires and including at least one spring-loaded carbon brush engageable with each of said supporting rods in a direction opposite that in which said strut braces said rod frame against said frame support, said spring-loaded carbon brushes being connected to an electric current supply.

7. The improvement defined in claim 5, further comprising lifting means engageable with said rod frame for removing it from said frame support after detachment of said strut.

8. The improvement defined in claim 7, further comprising at least one guide pin attached laterally adjacent a lower end of said rod frame, and a slanted guide bar attached to said frame support and engaging said guide pin.

9. The improvement defined in claim 7 wherein said lifting means is a pneumatic piston cylinder unit.

10. The improvement defined in claim 7 wherein said strut is a pneumatic piston cylinder unit.

11. The improvement defined in claim 7 wherein said radial socket coupling comprises two substantially trapezoidally-shaped coupler-halves narrowed in the lengthwise direction of said supporting rods toward said adjustable strut, said coupler-halves being each attached to a lower tapered, narrowed end of one of said supporting rods.

* * * * *